US007832555B2

(12) United States Patent
Flannery

(10) Patent No.: US 7,832,555 B2
(45) Date of Patent: Nov. 16, 2010

(54) APPARATUS FOR ASSISTING IN THE CHANGING OF DIAPERS

(75) Inventor: Mark A Flannery, Lakeville, MN (US)

(73) Assignee: Regalo International, LLC, Prior Lake, MN (US)

( * ) Notice: Subject to any disclaimer, the term of this patent is extended or adjusted under 35 U.S.C. 154(b) by 696 days.

(21) Appl. No.: 11/807,172

(22) Filed: May 27, 2007

(65) Prior Publication Data

US 2008/0289993 A1 Nov. 27, 2008

(51) Int. Cl.
*B65D 71/00* (2006.01)

(52) U.S. Cl. ..... 206/210; 206/581; 206/229; 206/812

(58) Field of Classification Search ..... 206/570, 206/572, 576, 581, 225, 229, 233, 207, 205, 206/449, 438, 440, 823, 210
See application file for complete search history.

(56) References Cited

U.S. PATENT DOCUMENTS 2,617,012 A * 11/1952 Westley ..... 219/385
4,904,848 A 2/1990 Colevas
5,113,637 A 5/1992 Gelbard
6,066,315 A 5/2000 Melby et al.
6,083,854 A 7/2000 Bogdanski et al.
6,144,016 A 11/2000 Garvin
6,364,158 B1 * 4/2002 Dimoulis ..... 221/238
6,419,125 B1 7/2002 Kim
6,488,948 B1 12/2002 Danieli
6,716,441 B1 4/2004 Osborne et al.
6,737,415 B2 5/2004 Cooper et al.
6,740,485 B1 5/2004 Holden et al.
6,776,305 B2 * 8/2004 Motsenbocker ..... 221/63
6,960,349 B2 11/2005 Shantz et al.
7,202,484 B1 * 4/2007 Tantillo ..... 250/455.11
RE40,408 E * 7/2008 McConnell et al. ..... 219/386
2003/0024942 A1 * 2/2003 Motsenbocker ..... 221/63
2007/0278242 A1 * 12/2007 Amundson et al. ..... 221/63

* cited by examiner

*Primary Examiner*—Jacob K Ackun, Jr.

(57) ABSTRACT

The apparatus includes a first compartment for storing and heating baby wipes, a second compartment for storing plastic bags for use as dirty diaper bags, a first fluid receptacle for holding and dispensing hand-lotion, a second fluid receptacle for holding and dispensing anti-bacterial lotion, and a tube receiving and squeezing mechanism that can hold one of a variety of tubes and that can squeeze cream such as diaper rash ointment from the tube.

13 Claims, 3 Drawing Sheets

APPARATUS FOR ASSISTING IN THE CHANGING OF DIAPERS

FIELD OF THE INVENTION

The present invention relates generally to apparatus for assisting in the changing of diapers, particularly to such an apparatus that stores, heats and dispenses baby wipes, stores and dispenses plastic bags for use as dirty diaper bags, contains and dispenses hand lotion, and contains and dispenses anti-bacterial lotion.

BACKGROUND OF THE INVENTION

Babies squirm, wiggle, and fall off diaper changing tables and stations. Falls are minimized by strapping the baby down and/or by keeping at least one hand on the child while using the other hand to wipe, clean, change clothes, spread lotion, and fasten snaps or buttons, to mention only a few of the steps performed multiple times during the day by the caregiver.

SUMMARY OF THE INVENTION

A feature of the present invention is a housing having multiple features for storing and dispensing a variety of wipes, bags and lotions for assisting in the changing of diapers.

Another feature of the present invention is the provision in such a housing, of a first compartment for storing and heating baby wipes, with the housing having a heating element confronting the first compartment such that the first compartment is heatable.

Another feature of the present invention is the provision in such a housing, of a second compartment for storing plastic bags for use as dirty diaper bags.

Another feature of the present invention is the provision in such a housing, of a first fluid receptacle in the housing, with the first fluid receptacle having a dispenser for dispensing fluid therefrom.

Another feature of the present invention is the provision in such a housing, of a second fluid receptacle in the housing, with the second fluid receptacle having a dispenser for dispensing fluid therefrom.

Another feature of the present invention is the provision in such a housing, of a tube receptor in the housing for receiving a tube, with the tube receptor including a pincher mechanism for squeezing fluid from the tube.

Another feature of the present invention is the provision of baby wipes in the first compartment.

Another feature of the present invention is the provision of plastic bags in the second compartment.

Another feature of the present invention is the provision of hand lotion in the first fluid receptacle.

Another feature of the present invention is the provision of anti-bacterial lotion in the second fluid receptacle.

Another feature of the present invention is the provision of a tube of baby rash ointment in the tube receptor.

A place for everything and everything in its place. This is one advantage of the present invention. Such permits a caregiver to change diapers safely and quickly. There is no need to hunt for stand alone tubes or stand alone bottles or stand alone bags or stand alone containers. Instead, with the present apparatus or organizer, the caretaker knows exactly where everything is by sight or by touch.

Another advantage of the present invention is that all of the sub-stations of the present invention can be operated with one hand. One hand turns the knob to squeeze cream from the tube. A thumb pushes down on the dispenser and the palm on the same hand receives the lotion. One finger pops open the lid on the sub-station for the baby wipes. One hand can grab a plastic bag for the dirty diaper. Hence, during this time, one hand can be holding the baby.

Parents differ. For example, parents buy different types and different brands of diapers. Parents select different types and different brands of lotions, disinfectants, creams, ointments, baby wipes, dirty diaper bags, and other fluids, lotions and accessories for assisting in the changing of diapers. An advantage of the present invention is that the preferred selections are present at one station or housing having a multiple number of sub-stations.

Baby wipes are cold. Such may be good or bad, depending upon one's perspective. When at room temperature, alcohol is one feature and simple moisture is a second feature that lend a cold feel to the baby wipe. An advantage of the present invention is an on-off switch for warming baby wipes, or keeping the baby wipes "cold" at room temperature if desired.

DESCRIPTION

Figure 1:
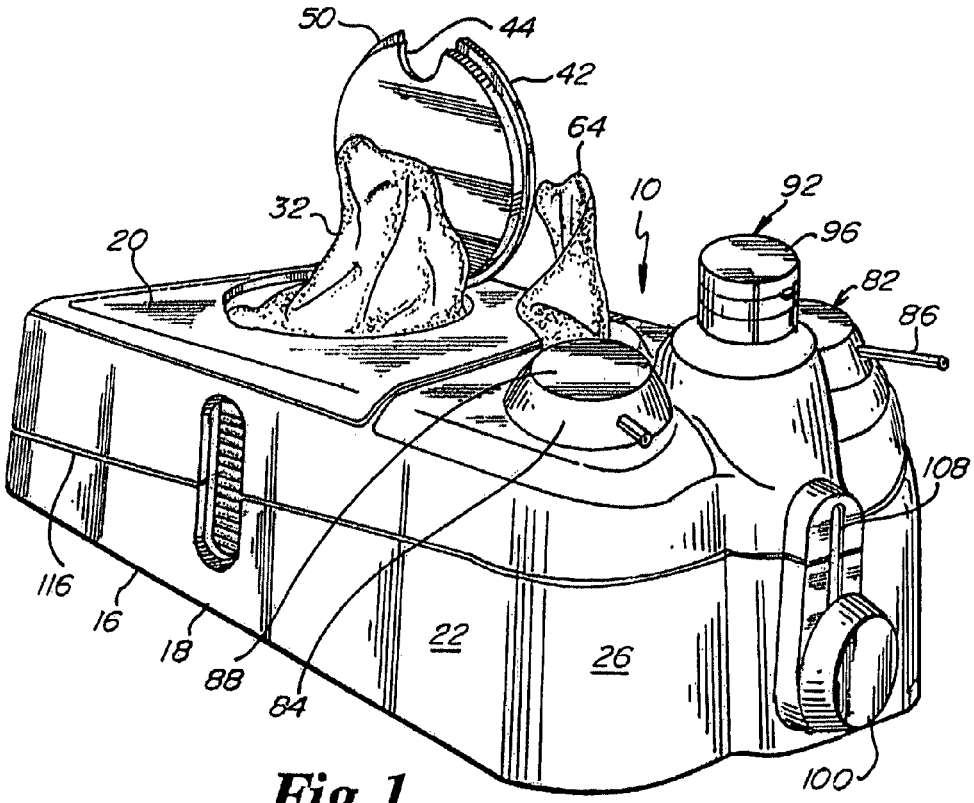
FIG. 1 is a perspective view of the present apparatus for assisting in the changing of diapers, showing a baby wipe partially removed from a first compartment, showing a bag partially removed from a second compartment where the bag is intended to hold dirty diapers, showing a dispenser on a first fluid receptacle, showing a dispenser on a second fluid receptacle, and showing a tube in a tube receptor.
Figure 2:
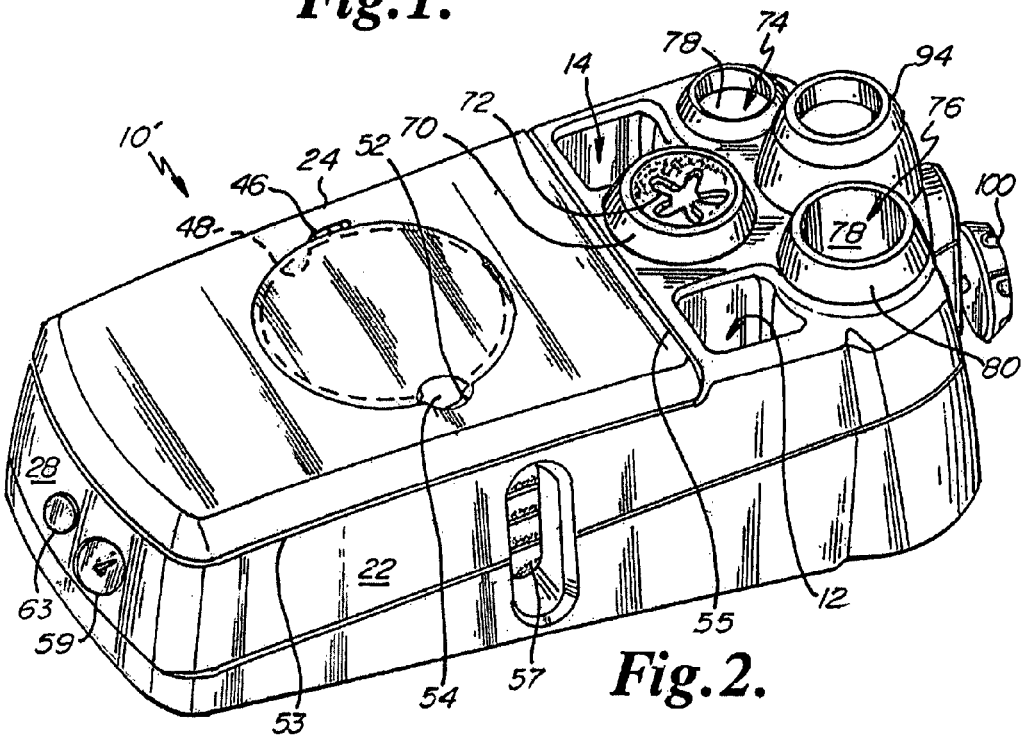
FIG. 2 is a perspective view of a slightly modified apparatus of FIG. 1, showing the lid closed on the first compartment having the baby wipes, showing the star shaped outlet for the second compartment having the bags for subsequently holding dirty diapers, showing the dispenser having been removed from the first fluid receptacle, showing the dispenser having been removed from the second fluid receptacle, showing the tube having been removed from the tube receptor, and further showing a pair of open ended receptacles for holding accessories such as combs and nail clippers.
Figure 3:
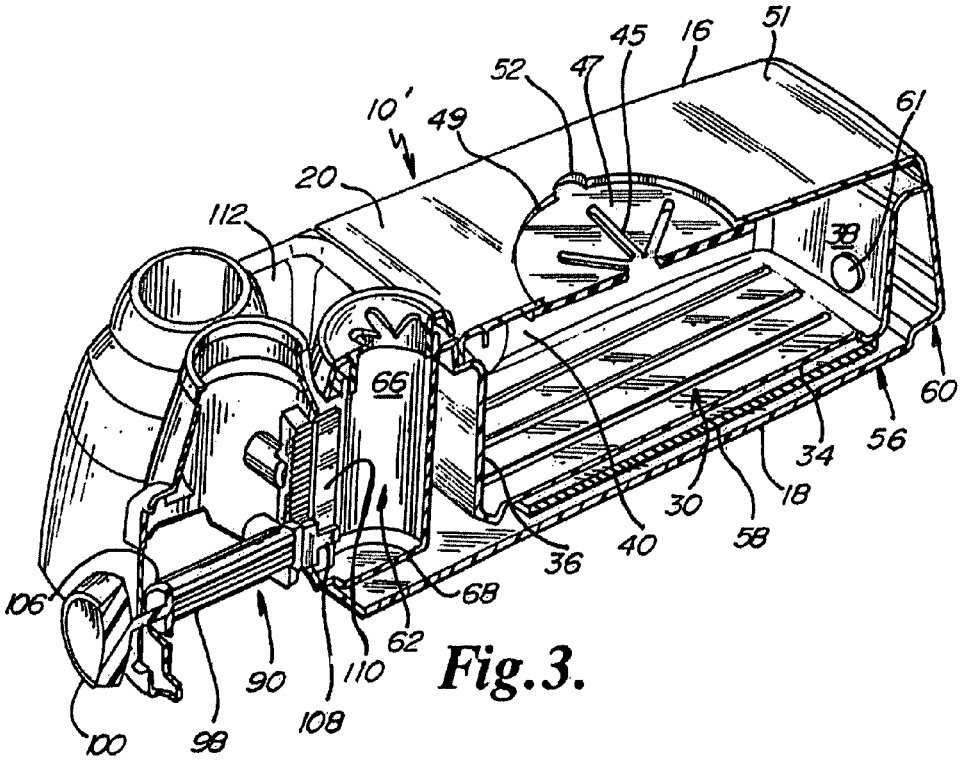
FIG. 3 is a section view of the apparatus of FIG. 2 showing the pincher mechanism for rolling up and squeezing the tube in the tube receptor, showing a removable cap for the second compartment that holds bags intended for use as dirty diaper bags, and showing a heating element for the first compartment holding the baby wipes.

One embodiment of the present apparatus is indicated in general by the reference number 10 and is shown in FIG. 1. A slightly modified embodiment of the present apparatus is indicated in general by the reference number 10' and is shown in FIGS. 2 and 3. The only difference between the two embodiments is the provision of first and second open ended receptacles 12 and 14 shown in FIGS. 2 and 3. Otherwise, all of the reference numbers and the features represented thereby are interchangeable between the two embodiments.

Each of apparatus 10 and 10' includes a housing 16. As exterior portions, housing 16 includes a lower portion 18 opposite an upper portion 20, a first side portion 22 opposite a second side portion 24, and a first end portion 26 opposite a second end portion 28.

Housing 16 further includes a sealed, first compartment 30 for storing baby wipes 32. First compartment 30 is formed by upper portion 20, interior floor portion 34, interior front end portion 36, interior rear end portion 38, and side portions 40 running to and between interior front end portion 36 and interior rear end portion 38. First compartment 30 is further formed by a lid 42 for gaining access to the interior of the compartment 30 such as for gaining access to baby wipes 32. Lid 32 is generally shaped in the form of a circular disk and includes a cutout 44 such that one finger can engage the cutout 44 to lift the lid 42 such that opening of the lid 42 is a one handed operation. A baby wipe 32 can be pulled from the compartment 30 via a star shaped opening 45 formed in a sunken platform 47 that receives and mates with the lid 42. Closing of the lid 42 is also a one handed operation because one hand can tuck any protruding baby wipes 32 flat and one hand can press down on the upper face of the lid 42 to return the lid 42 to a closed position. Opposite cutout 44, the lid 42 can engage housing 16 via a hinge 46. Lid 42 can further include an O-ring 48 disposed about the rim of lid 42 and tucked into a right angle portion 50 formed immediately under the rim of the lid 42 to aid in sealing the first compartment 30 for retaining moisture in the baby wipes 32. O-ring 48 can engage an annular edge 49 depending from the upper portion 20 down to the sunken platform 47. First compartment 30 can further include a cutout 52 that is formed in the mirror image of cutout 44 and that is formed opposite of cutout 44 when the lid 42 is closed. A resilient plastic piece or pop latch 54 is formed in the shape of the cutouts 44 and 52 when such cutouts are combined and is engaged to the upper portion 20 in the openings formed by cutouts 44 and 52. Resilient plastic piece or pop latch 54 can house a latch that engages the rim of the lid 42. Resilient plastic piece or pop latch 54 is depressible such that a finger can depress the piece 54 and underlying latch such that the lid 42, if biased via a spring in hinge 46, can pop up or spring open. A finger can also engage lid 42 via the cutout 44. Resilient plastic piece or plug 54 may also plug or seal the cutouts or the cutout openings to further aid in sealing the first compartment 30 for retaining moisture in the baby wipes.

The first compartment 30 is preferably sealed against loss of moisture or to minimize the loss of moisture, and the O-ring 48 provides one feature for such a seal. First compartment 30 further includes a base lid 51 having a base lid periphery 53. Base lid 51 opens at the second end 28 of the housing 16 and is hinged at one or more locations along a peripheral portion 55, which peripheral portion 55 extends from housing side portion 22 to housing side portion 24. Base lid 51 generally extends the width of the housing 16 such that lid 51 extends from housing side portion 22 to housing side portion 24. The length of base lid 51 is generally between one-half and three-quarters the length of the housing 16, i.e., from housing end portion 28 to housing end portion 26. Base lid 51 includes baby wipe accessing lid 42. Base lid 51 may also include a seal, such as an O-ring seal, about the periphery 53 to seal compartment 30 against loss of moisture or to minimize the loss of moisture. Base lid 51 provides the means to access compartment 30 to resupply compartment 30 with a parallelepiped stack of baby wipes 32. Then, after the compartment 30 is resupplied via base lid 51, individual baby wipes 32 can be removed via the star shaped opening 45 and the lid 42.

Compartment 30 further includes a window 57. Window 57 is recessed in housing side portion 22 and provides a means for viewing the stack of baby wipes 32 without opening the compartment 30 to determine when compartment 30 needs to be resupplied with baby wipes 32. Window 57 is preferably a transparent window formed of a plastic. Window 57 is recessed such that window 57 closely confronts, or even abuts, the parallelepiped stack of baby wipes 32. Such a recessed location is preferable because moisture from heated compartment 30 may collect on the inside of the window 57. However, visual inspection via window 57 is made easier when the stack of baby wipes 32 is closer to the inside of the window 57. Window 57 is elongate and runs in the direction from housing lower portion 18 to housing upper portion 20.

As to baby wipe 32 and to what a baby wipe is, the following U.S. Patents are hereby incorporated by reference in their entireties: 1) the Bogdanski et al. U.S. Pat. No. 6,083,854 issued Jul. 4, 2000 and entitled Wet Wipes With Low Viscosity Silicone Emulsion Systems; and 2) the Shantz et al. U.S. Pat. No. 6,960,349 issued Nov. 1, 2005 and entitled Premoistened Wipe With Lotion To Improve Dispensing. Generally, baby wipes 32 are premoistened, disposable towelettes used primarily during diaper changes for cleansing. The wipe 32 is constructed of various combinations of synthetic (e.g. polyolefin) fibers, viscose fibers, cotton fibers, cellulose fibers, other synthetic fibers, or natural fibers. Wipes 32 are generally moistened with water and/or alcohol and contain various combinations of emulsion systems or agents, cleaning agents, surfactants, preservatives and scents.

Housing 16 further includes a floor chamber 56 for containing a heating element 58 for heating the first compartment 30. Floor chamber 56 is formed between interior floor portion 34 and lower portion 18 of housing 16. Heating element 58 is about the length and width of interior floor portion 34, or slightly less than such length and width, and is about the height of floor chamber 56 or slightly less than such height. Heating element 58 is a resistance heating element and can be powered by batteries and/or by conventional alternating residential current. Batteries may be housed in a chamber 60 formed by the interior rear end portion 38 and second end 28 of housing 16 and/or such chamber 60 may house electrical apparatus and electrical cords for accessing residential household alternating current. Heating element 58 may include a variable switch 59 such that the baby wipes 32 can be provided at a desired temperature such as warm, warmer, or warmest or at some temperature in-between. Heating element 58 may include or be engaged to an automatic on/off switch 61 in compartment 30 that can sense when the baby wipes 32, or the surrounding environment, are too hot or too cold. Heating element 58 may include a separate on/off switch 63 for the power source itself, whether such power source is a battery or batteries or residential alternating current. As to the heating element 58, its power sources and other features that it can include, the following U.S. Patents are hereby incorporated by reference in their entireties: 1) the Colevas U.S. Pat. No. 4,904,848 issued Feb. 27, 1990 and entitled Portable Cooling And Heating Device; and 2) the Garvin U.S. Pat. No. 6,144,016 issued Nov. 7, 2000 and entitled Heating Element Lunch Box.

Housing 16 further includes a second compartment 62 for containing plastic bags 64 intended for holding one or more dirty diapers. As shown in FIG. 3, second compartment 62 includes an cylindrical shaped endless sidewall 66 stemming upwardly from a disk shaped floor 68. Floor 68 is spaced from lower portion 18 of housing 16. An upper portion of sidewall 66 is engaged, such as by welding or molding, to the upper portion 20 of housing 16. Opposite floor 68 and engaging a threaded upper end of sidewall 66 is a threaded cap 70 such that cap 70 is removable from the second compartment 62 such that a roll of plastic bags 64 can be inserted into the second compartment 62. Cap 70 includes a star shaped opening or cutout 72 to provide teeth to tear one plastic bag 64 from another plastic bag 64 where perforations are formed between the adjacent bags 64. The step of pulling out and removing a plastic bag 64 is a one handed step or operation because the star shaped opening or cutout 72 and its teeth provides a tool for tearing one plastic bag 64 from an adjacent plastic bag 64 without holding onto the second plastic bag 64 down line with the other hand. As to plastic bag 64, the Gelbard U.S. Pat. No. 5,113,637 issued May 19, 1992 and entitled Nested Plastic Bags And Method Of Manufacture is hereby incorporated by reference in its entirety.

It should be noted that sub-station 62 is an example of a sub-station that can be molded or removably engaged to housing 16. For example, sub-station 62 may be provided as a removable sub-station having sidewall 66, floor 68 and cap 70, including star shaped opening 72. Sub-stations 74, 76 and 90 may also include such a receptacle, having a sidewall, floor and cap, minus the star shaped opening 72.

Housing 16 further includes a first fluid receptacle 74 and a second fluid receptacle 76. Like the second compartment 62, each of the receptacles 74 and 76 includes an endless cylindrical sidewall 78 and a floor such that each of the receptacles 74 and 76 can contain fluid, including viscous cream like fluids or relatively minimally viscous fluids like water. Each of the receptacles 74 and 76 is engaged to the housing 16 and includes an upper annular frustoconical portion 80. The upper annular frustoconical portion 80 serves as a base for a dispenser 82. The dispenser 82 includes a cap 84 that engages the upper annular frustoconical portion 80 and further includes a nozzle 86. As to the dispenser 82, the Kim U.S. Pat. No. 6,419,125 B1 issued Jul. 16, 2002 and entitled Dispenser is hereby incorporated by reference in its entirety such that the dispenser 82 can include a portion that can be depressed to pump fluid from one of the receptacles 74, 76, one or more valves, valve stems, springs, and other features to pump fluid from the bottom or near the bottom of the receptacles 74, 76. Cap 84 can engage upper annular frustoconical portion 80 via a snap action or via threads. Since the dispenser 82 can be in the nature of a pump where a portion, such as a button portion 88, can be depressed to operate the dispenser 82, the thumb can depress the button portion 88 and the palm of the same hand can receive the fluid from the nozzle 86. It should be noted that the first and second fluid receptacles 74 and 76 do not engage the original bottle or container in which the respective fluid, such as hand-lotion or anti-bacterial lotion, is originally contained. Such purchased original bottle or container of fluid is opened and its contents poured into the desired first or second fluid receptacle 74, 76.

As to hand lotion that can be used in the first fluid receptacle 74, and as to what a hand lotion is, such hand lotion may include skin conditioners such as emollients or humectants. Emollients generally provide improved moisture retention in the skin and plasticization/softening of the skin. Humectants generally attract moisture, retard evaporation of water from the skin surface, and plasticize/soften skin. Preferred hand lotions or skin lotions for use in the first fluid receptacle 74 that are emollients include mineral oil; petrolatum; aliphatic alcohols, such as stearyl alcohol; lanolin and its derivatives; glycol stearate; and fatty acids, such as triethanolamine oleate. Preferred hand lotions or skin lotions for use in first fluid receptacle 74 that are humectants include glycerin, propylene glycol, sorbitols, and polyethylene glycols. As to hand or skin lotions for use in the first fluid receptacle 74, and as to what a hand or skin lotion is or can be, the Melby et al. U.S. Pat. No. 6,066,315 issued May 23, 2000 and entitled Ampholyte Polymers For Use In Personal Care Products is hereby incorporated by reference in its entirety.

As to the anti-bacterial lotion or fluid that contains an anti-bacterial agent and that can be used in the second fluid receptacle 76, and as to what an anti-bacterial agent is, the following U.S. Patents are hereby incorporated by reference in their entireties: 1) the Danieli U.S. Pat. No. 6,488,948 B1 issued Dec. 3, 2002 and entitled Anti-Bacterial Composition And Use Thereof For Skin Care And Fabric Treatment; 2) the Cooper et al. U.S. Pat. No. 6,737,415 B2 issued May 18, 2004 and entitled Anti-Bacterial Agents Based Upon Oxoanion Binding; and 3) the Holden et al. U.S. Pat. No. 6,740,485 B1 issued May 25, 2004 and entitled Anti-Bacterial Methods and Materials. Preferably the anti-bacterial lotion in the second fluid receptacle 76 includes an anti-bacterial agent effective against or being targeted for a *Staphylococcal* strain.

The housing 16 further includes a tube receptor 90 for receiving a tube 92 filled with fluid and for squeezing fluid from the tube 92. Tube receptor 90 includes an annular frustoconical portion 94 engaged to the housing 16 for receiving the head or outlet portion 96 of the tube 92. Tube receptor 90 further includes a slotted roller or pincher mechanism 98, a knob 100 extending axially from the slotted roller 98 and further extending from the housing 16, a toothed annular gear 102 that extends axially from the slotted roller 98, and a vertically extending toothed track 104 that meshes with the toothed gear 102. Tube receptor 90 further includes an axially extending neck 106 between the knob 100 that rides in a vertical slot 108 formed in the housing 16 and a key or guide that rides in a vertical slot 110 formed in the housing 16 between the toothed track 104 and the second compartment 62. The permanently closed or distal end of the tube 92, often formed in the shape of a wedge, is inserted into a slot running lengthwise or axially along slotted roller 98. Then the knob 100 is turned to roll up and pinch the lower or permanently closed or distal end of the tube 92, thereby pinching or squeezing fluid, such as a cream, out of the outlet portion 96 of the tube 92. Such an operation can be performed with one hand by first opening a cap on outlet portion 96, then turning the knob 100 to roll up the closed end of the tube 92 such that a bead of fluid is formed at the outlet portion 96, and then wiping off the bead of fluid with the fingers or palm of the hand.

As to a fluid or cream that can be contained in tube 92, and as to what a diaper rash ointment or cream is, the Osborne et al. U.S. Pat. No. 6,716,441 B1 issued Apr. 6, 2004 and entitled Compositions For Efficient Release Of Active Ingredients is hereby incorporated by reference in its entirety. Tube 92 can include one or more ingredients or agents that alleviate or are effective against diaper dermatitis or minimize the chances of the occurrence of diaper dermatitis or that target diaper dermatitis. Tube 92 can include physical barriers such as topical creams, ointments, lotions, and pastes. These physical barriers can include zinc oxide. Tube 92 can also include skin conditioning agents such as lanolin, pH buffer substances, and protease and/or enzyme inhibitors.

It should be noted that pincher mechanism 98 may include a pair of rollers, between which the closed or distal end of the tube is engaged. A gear mechanism can then force the rollers toward each other and in the upwardly direction, thereby squeezing the tube from both sides and forcing fluid from the open or proximal end of the tube. The gear mechanism may be actuated in several ways, such as by a wheel or knob that is turned manually, or such as by a biased incremental claw mechanism, where a downward push on top of the tube releases a claw, thereby actuating the gear mechanism to push the rollers together and upwardly to squeeze a bead of fluid from the top of the tube.

As indicated above, apparatus 10' includes open ended receptacles 12, 14. An upper portion of such receptacles 12, 14 can be engaged to the housing 16. Each of receptacles 12, 14 includes an endless sidewall that can be generally square or rectangular in section. Accessories such as combs, brushes, nail clippers, and cotton swabs can be picked up from the receptacles 12, 14 with one hand.

Apparatus 10 or 10' can be referred to as a station. Each of the first compartment 30, second compartment 62, first fluid receptacle 74, second fluid receptacle 76, tube receptor 90, first open ended receptacle 12, and second open ended receptacle 14 can be referred to as a sub-station.

The locations of the sub-stations as shown in FIGS. 1, 2 and 3 are the preferred locations. It is preferred that the first and second fluid receptacles 74, 76 and tube receptor 90 confront the vertically extending portions of the housing 16, such as the sides 22, 24 and end 26, such that the palm of the hand can easily receive fluid from the nozzles 86 and outlet 96 without interference from the housing 16 or other sub-stations. It is preferred that the first compartment 30, relatively heavy with moist baby wipes 32, be offset with the combined weight of the fluid in the first and second fluid receptacles 74, 76 and tube 92. It is preferred that the second compartment 62, having a roll of relatively heavy plastic bags 64 be disposed generally in the middle front portion of the housing 16 to stabilize the housing 16. In other words, sub-stations 62, 74, 76, and 90 confront one end of the housing 16 and sub-station 30 confronts the other end of the housing 16. Sub-station 90 is disposed generally between sub-stations 74 and 76 and further includes outlet 96 at a height greater than the height of nozzles 86 of sub-stations 74 and 76. Sub-station 62 is disposed generally between sub-stations 90 and 30. All sub-stations 30, 62, 74, 76, 90, 12 and 14 dispense their respective articles and fluid from an upper face or upper portion 20 of the housing 16. With such an orientation of the sub-stations 30, 62, 74, 76, 90, 12 and 14, a caregiver can access such articles and fluid easily by sight or by touch. A caregiver can keep his or her eyes on the baby and, at the same time, move his or her hand to the desired sub-station 30, 62, 74, 76, 90, 12, or 14 and collect via a one-handed operation the desired article, fluid or thing.

Each of FIGS. 4, 5, 6 and 7 illustrate that the pop latch 54 can be oriented so as to be on a longitudinal axis of the housing 16. Hinge 46 can be disposed diametrically opposite latch 54 to also be disposed on the longitudinal axis of the housing 16.

Figure 4:
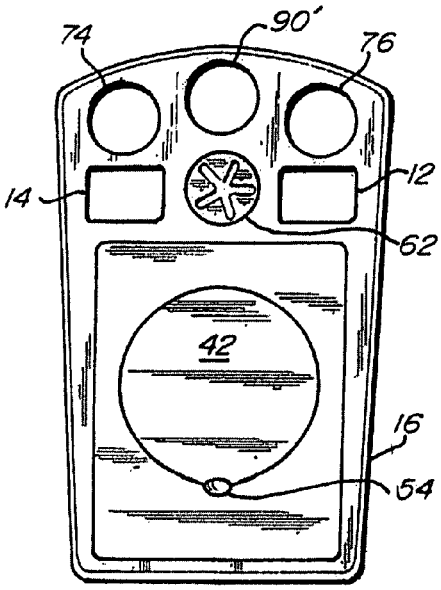
FIG. 4 is a diagrammatic top view of an alternate embodiment of the invention.

FIG. 4 illustrates an embodiment where each of sub-stations 12, 14, 62, 74, 76, and 90' is a receptacle with a sidewall and a floor. The sidewall and floor are preferably solid such that such receptacle can hold a fluid such as water. However, if desired, such sidewall and floor can be perforated or in the nature of a screen. In FIG. 4, each of sub-stations 12, 14, 74, 76 and 90' is molded to housing 16.

Figure 5:
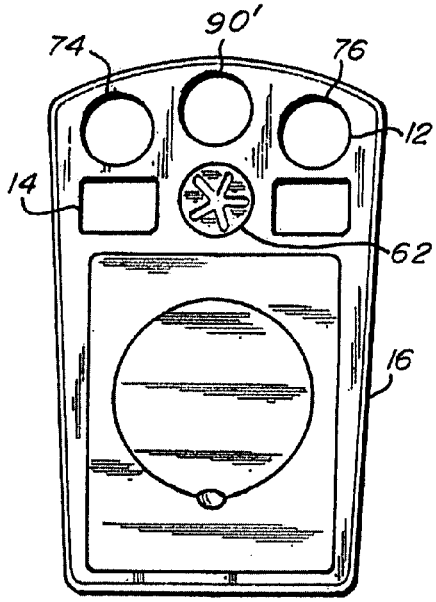
FIG. 5 is a diagrammatic top view of an alternate embodiment of the invention.

FIG. 5 illustrates an embodiment where each of sub-stations 12, 14, 62, 74, 76, and 90' is a receptacle with a sidewall and a floor. The sidewall and floor are preferably solid such that such receptacle can hold a fluid such as water. However, if desired, such sidewall and floor can be perforated or in the nature of a screen. In FIG. 5, one or more of the sub-stations 12, 14, 62, 74, 76 and 90' is removably engaged to housing 16 such as via a friction fit or a threaded arrangement. For example, sub-stations 74, 76 and 90' may be shaped in the form of a cup or closed tube and have an upper rim that is snapped or screwed into the housing 16. Or such upper rim is simply larger in diameter than the diameter of the opening in the housing 16 for the sidewall of the sub-station, such that the sub-station is neither snapped nor screwed in place, but merely stays in position via the upper rim preventing the sub-station from falling into the housing 16. Also, sub-stations may be interchangeable as to position. For example, sub-station 62, having a roll of plastic bags 64 therein, may be interchangeable as to position with sub-stations 74 and 76.

Figure 6:
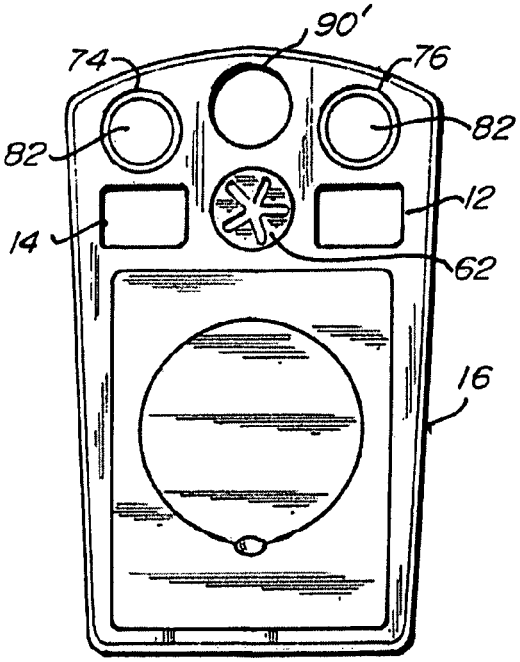
FIG. 6 is a diagrammatic top view of an alternate embodiment of the invention.

FIG. 6 illustrates an embodiment like the embodiment of FIG. 5, except that sub-stations 74 and 76 may have dispensers 82 associated therewith such that receptacles 74 and 76 and their respective dispensers 82 may be engageable with and disengageable from the housing 16.

Figure 7:
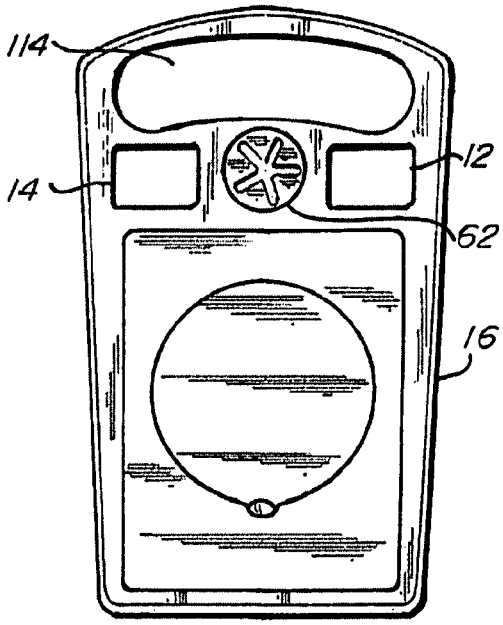
FIG. 7 is a diagrammatic top view of an alternate embodiment of the invention.

FIG. 7 illustrates an embodiment where sub-stations 74, 76 and 90' have been combined to form an oblong laterally extending receptacle 114 molded to the housing 16.

Each of the housings 16 of each of the FIGS. 1-7 is tapered from end 26 to end 28. That is, end 26 includes a height greater than the height of end 28, with upper portion 20 generally tapering downwardly from end 26 to end 28. Housing 16 if formed generally in two parts, with a mold line 116 defining each of such parts. Mold line 116 extends about the entire housing 16 from side 22 to end 26 to side 24 to end 28 and back to side 22.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. An apparatus for assisting in the changing of diapers, comprising:

a) a housing;

b) a first compartment in the housing, with the first compartment having an outlet, and with the housing having a heating element confronting the first compartment such that the first compartment is heated;

c) a second compartment in the housing, with the second compartment having an outlet;

d) a first fluid receptacle in the housing, with the first fluid receptacle having a dispenser for dispensing fluid from the first fluid receptacle;

e) a second fluid receptacle in the housing, with the second fluid receptacle having a dispenser for dispensing fluid from the second fluid receptacle;

f) moistened wipes, with the moistened wipes being in the first compartment;

g) plastic bags, with the plastic bags being in the second compartment;

h) hand lotion, with the hand lotion being in the first fluid receptacle; and i) anti-bacterial lotion, with the anti-bacterial lotion being in the second fluid receptacle.

2. The apparatus of claim 1, wherein the hand lotion includes an emollient.

3. The apparatus of claim 1, wherein the hand lotion includes an humectant.

4. The apparatus of claim 1, wherein said anti-bacterial lotion includes an anti-bacterial agent, and wherein the anti-bacterial agent is a Staphylococcal strain anti-bacterial agent.

5. The apparatus of claim 1, wherein said first compartment includes a lid engaging said outlet of said first compartment and a seal disposed between the lid and the first compartment.

6. The apparatus of claim 1, wherein said outlet of said second compartment comprises a star shape.

7. The apparatus of claim 1, wherein the first fluid receptacle includes a cap, with said dispenser of said first fluid receptacle being engaged to said cap.

8. The apparatus of claim 1, wherein the second fluid receptacle includes a cap, with said dispenser of said second fluid receptacle being engaged to said cap.

9. An apparatus for assisting in the changing of diapers, comprising:

a) a housing;

b) a first compartment in the housing, with the first compartment having an outlet, and with the housing having a heating element confronting the first compartment such that the first compartment is heated, and further comprising a set of moistened wipes in the first compartment;

c) a second compartment in the housing, with the second compartment having an outlet, and further comprising a set of plastic bags in the second compartment;

d) a first fluid receptacle in the housing, with the first fluid receptacle having a dispenser for dispensing fluid from the first fluid receptacle, and further comprising hand lotion in the first fluid receptacle, with the hand lotion including at least one of an emollient and humectant; and e) a second fluid receptacle in the housing, with the second fluid receptacle having a dispenser for dispensing fluid from the second fluid receptacle, and further comprising anti-bacterial lotion in the second fluid receptacle, with the anti-bacterial lotion having an anti-bacterial agent, with said bacterial agent being targeted for a Staphylococcal strain.

10. An apparatus for assisting in the changing of diapers, comprising:

a) a housing;

b) a first compartment in the housing, with the first compartment having an outlet, and with the housing having a heating element confronting the first compartment such that the first compartment is heated;

c) a second compartment in the housing, with the second compartment having an outlet;

d) a first fluid receptacle in the housing, with the first fluid receptacle having a dispenser for dispensing fluid from the first fluid receptacle;

e) a second fluid receptacle in the housing, with the second fluid receptacle having a dispenser for dispensing fluid from the second fluid receptacle; and f) a tube receptor in the housing for receiving a tube, with the tube receptor including a pincher for pinching the tube to expel fluid from the tube.

11. The apparatus of claim 10 in combination with a tube having diaper rash cream, with the tube being in the tube receptor and engaged to the pincher.

12. The apparatus of claim 10, wherein the diaper rash cream includes an agent that targets diaper dermatitis.

13. The apparatus of claim 10, wherein said pincher includes a knob, with the knob controlling pinching of said tube by said pincher, with the knob being disposed outside said housing.

* * * * *